United States Patent [19]

Castellucci

[11] 4,120,996

[45] Oct. 17, 1978

[54] METHOD OF PROVIDING CORROSION RESISTANCE TO METAL SURFACES

[75] Inventor: Nicholas T. Castellucci, Pittsburgh, Pa.

[73] Assignee: PPG Industries, Inc., Pittsburgh, Pa.

[21] Appl. No.: 799,880

[22] Filed: May 23, 1977

[51] Int. Cl.[2] ..... B05D 3/10; B05D 3/00; B05D 1/38

[52] U.S. Cl. ..... 427/318; 427/327

[58] Field of Search ..... 427/318, 327; 428/457, 428/409

[56] References Cited

U.S. PATENT DOCUMENTS

| | | | |
|---|---|---|---|
| 1,798,218 | 3/1931 | Pacz | 148/6.14 X |
| 3,349,043 | 10/1967 | Manning | 252/407 |
| 3,586,543 | 6/1971 | Iijima et al. | 148/6.14 |

OTHER PUBLICATIONS

Levyanto et al, Chem. Abstr., vol. 76, 62213 (1972; Abstract of Konserv. Ovoshchesush, Prom. 1971, 26(9), 13–14.

*Primary Examiner*—James R. Hoffman
*Attorney, Agent, or Firm*—William J. Uhl

[57] ABSTRACT

A method of providing corrosion resistance to metal surfaces is disclosed. The method of the invention involves treating the metal surfaces with an ascorbic acid (Vitamin C)-containing composition free of beta-diketones and preferably in combination with molybdenum. The invention is particularly effective as a passivating pretreatment for ferrous metal substrates which are to be subsequently topcoated.

11 Claims, No Drawings

METHOD OF PROVIDING CORROSION RESISTANCE TO METAL SURFACES

BACKGROUND OF THE INVENTION

1. Field of the Invention

This invention relates to the treatment of metal surfaces for corrosion protection. More particularly, this invention relates to the pretreatment of metal, particularly ferrous metal surfaces to passivate the surface and improve subsequent coating properties.

2. Brief Description of the Prior Art

It is well known in the prior art that chromic acid pretreatments passivate and improve the corrosion resistance and coating properties of metals, particularly ferrous metal surfaces. However, chromic acid pretreatments are undesirable because chromic acid is toxic and its effluent creates serious pollution problems. The present invention resides in the discovery that ascorbic acid-containing compositions, free of beta-diketones, and preferably in combination with molybdenum, can be used to passivate metal surfaces, particularly ferrous metal surfaces. Besides improving the corrosion resistance and subsequent coating properties of the treated metal surfaces, the compositions employed in the present invention are ecologically acceptable.

SUMMARY OF THE INVENTION

In accordance with the present invention, a method of providing corrosion resistance to a metal surface is provided. The method of the invention comprises pretreating the metal surface with an ascorbic acid-containing composition free of beta-diketones, and preferably in combination with elemental molybdenum to passivate the surface, followed by directly coating the passivated metal surface.

The pretreatments of the present invention render the metal surfaces resistant to corrosion without the application of a coating detectable by eyesight or weight change of the pretreated metal. Thus, passivating pretreatments of the present invention are distinguished from coating metal surfaces with corrosion inhibiting primers which are visually detectable and do result in a weight gain for the coated metal. Also, the treated metal surfaces obtained in accordance with the present invention are electrically conductive such that they can be subsequently electrocoated. Most corrosion inhibiting primers cannot be subsequently electrocoated unless they contain specially added electroconductive pigments.

The improved resistance to corrosion provided by the treatments of the present invention can be determined by comparing for salt spray corrosion topcoated steel panels which have, and have not been treated in accordance with the present invention.

The expression "direct coating" as used in the context of the present specification and claims means that after the passivating pretreatment, the metal surface is coated without extensive cleaning or degreasing treatments, although after pretreatment, the metal surface is rinsed such as with water and dried before topcoating.

PERTINENT PRIOR ART

U.S. Pat. No. 3,349,043 to Manning et al discloses ascorbic acid-containing compositions in combination with beta-diketones for removing rust from metal surfaces. The compositions are also disclosed as being useful in pretreating fresh, clean metal surfaces as a pretreatment before painting or other surface coating to prevent oxidation. However, the compositions of the reference are considerably less desirable than compositions of the present invention because of the pesence of the beta-diketones which have high vapor pressures, are noxious, irritating to the skin and flammable. In addition, when properly applied, the ascorbic acid-containing compositions of the present invention free of beta-diketones, and preferably in combination with molybdenum, are equal to and, in certain cases, superior to the beta-diketone-containing composition of U.S. Pat. No. 3,349,043 for passivating metal surfaces before topcoating.

Other prior art dealing with the use of ascorbic acid in the corrosion treatment of metals is an article entitled "Inhibitors for Protecting Chromium Plated Sheet Iron from Corrosion" appearing in *Konserv. Ovoshchesuch. Prom.*, 1971, 26 (9), 13–14. This article reports that corrosion protection of chromium-plated thin iron sheets was tested in various corrosion media, for example, acetic acid, sodium chloride, malic acid, citric acid and lactic acid and ascorbic acid in combination with gelatin showed significant corrosion inhibiting effects. However, there is no teaching in this reference of using ascorbic acid-containing compositions in the method provided by the present invention, that is, pretreating the metal with ascorbic acid followed by topcoating the pretreated metal surface. Also, there is no disclosure in the reference of combining ascorbic acid with molybdeum for an improved corrosion inhibiting composition.

The use of water-soluble molybdenum-containing compounds for treating metals of provide corrosion resistance is also known in the art. For example, U.S. Pat. No. 1,798,218 to Pacz discloses molybdenum-containing compounds either alone or in combination with organic acids such as gallic acid, tannic acid or oxalic acid for use in corrosion inhibiting coatings.

U.S. Pat. No. 3,586,543 to Iijima et al discloses that corrosion-resistant films can be formed on metal surfaces by treating the metals with solutions of molybdic acid or a salt thereof and a water-soluble organic polymer. Optionally, these treating solutions can also contain an acid such as a mineral acid, acetic acid, tartaric acid or citric acid. Somewhat surprisingly, it has been found that in the practice of the present invention, molybdic acid and various molybdenum salts are not as effective in providing corrosion protection as is elemental molybdenum.

DETAILED DESCRIPTION

The relative proportions of elemental molybdenum and ascorbic acid necessary for effective corrosion pretreatment can vary. The weight ratio of ascorbic acid to molybdenum should be at least 5:1 and usually within the range of from about 5 to 50:1.

For application to the metal surface, the molybdenum usually in powder form and ascorbic acid are usually mixed with a compatible liquid, preferably in aqueous medium. Because of availability and cost, water is preferred, although other liquids such as alcohols and esters can be used. Mixtures of the various liquids including water can be used. Preferably, water constitutes about 90 to 100 percent by weight of the liquid. In general, the treating composition will contain at least 0.05 and preferably 0.05 to 5 percent by weight of molybdenum, at least 5 and preferably 5 to 24 percent by weight of ascorbic acid, and at least 75 and preferably 75 to 94 percent by weight of liquid; the percentages by weight being based on total weight of molybdenum, ascorbic acid and liquid. Where ascorbic acid is used without molybdenum, it is used in a concentration of at least 5 and preferably from about 5 to 24 percent by weight of the treating composition, the percentage by weight being based on total weight of liquid and ascorbic acid. higher concentrations of ascorbic acid can be used, but no added advantage is obtained.

In the practice of the invention, the metal surface is contacted with the treating composition under conditions sufficient to passivate the metal surface. Contacting can be by immersion, spraying, flooding, brushing, wiping and roll coating.

The preferred way of treating the metal substrate is to form a liquid solution or dispersion of the treating ingredients and then immerse the metal to be treated. The times and temperatures of immersion are important and depend on the temperature of the immersion bath, the concentration of the various active ingredients in the bath and the metal being treated. For example, previously treated iron phosphated steel only requires a 6 to 12 second immersion, whereas cold rolled steel requires about 2.5 to 5 minute immersion for acceptable corrosion pretreatment. In general, the metal article should be immersed for at least 6 seconds, usually from about 8 seconds to 12 minutes, followed by removal of the article from the bath and rinsing. Rinsing is believed to remove excess treating composition from the surface of the panel. Rinsing can be with many liquids such as water, organic solvents or water-organic solvent combinations. The temperature of the immersion bath is also important and usually is at least room temperature, preferably between 35° to 50° C. Immersion pretreatment at higher and lower temperatures gives poorer corrosion protection. After removal of the article from the immersion bath and rinsing with deionized water, the article is dried either by blowing with air or by heating to an elevated temperature to evaporate the liquid.

After drying, the metal surface is then directly coated with a film-forming material. The coating can be an adhesive coating or a protective coating such as a layer of paint.

The invention is particularly useful for treating ferrous metal surfaces such as untreated or cold rolled steel and steel which has been previously pretreated, such as iron phosphated or zinc phosphated steel. Although not actually evaluated, the method of the invention should be useful for treating other metals such as copper, aluminum, brass and magnesium.

The invention is further described in connection with the following examples which are to be considered illustrative rather than limiting. All parts and percentages in the examples and throughout the specification are by weight unless otherwise stated.

EXAMPLES 1-13

In Examples 1-13, ascorbic acid was used for treating both cold rolled steel and previously treated iron phosphated steel panels.

The ascorbic acid was dissolved in deionized water to form a 10 percent solution. Alkaline rinsed, cold rolled (untreated) and previously treated iron phosphated steel panels were dipped in the ascorbic acid bath at 40° C. for various times as is reported in the table below. The steel panels were then removed from the bath and further processed as described in the table below. After drying, the pretreated panels were topcoated with a thermosetting acrylic coating composition sold commercially by PPG Industries, Inc. under the trademark DURACRON 200. The topcoating was accomplished by drawing down to approximately 1 mil thickness with a drawbar. The topcoated sample was then baked for 8 minutes at 400° F. (204° C.), scribed with an "X" and placed in a salt spray chamber at 100° F. (38° C.) and 100 percent relative humidity atmosphere of a 5 percent by weight aqueous sodium chloride solution for one week. The panels were then removed from the chamber, dried, the scribe mark taped with marking tape, the tape pulled off at a 45° angle and the creepage from the scribe mark measured. The results are reported in Table I below. Creepage is a rusted darkened area of the panel where the coating has lifted from the panel surface.

Scribe creepage results for control panels of both alkaline rinsed cold rolled (untreated) and previously treated steel panels are also reported in Table I.

Table I

| Example No. | Previous Steel Panel Treatment | Ascorbic Acid Pretreatment Conditions | Scribe Creepage in millimeters (mm) |
|---|---|---|---|
| Control | untreated | none | 12 |
| Control | iron phosphated | none | 3.8 |
| Control | iron phosphated with chromic acid rinse | none | 0.8 |
| Control | zinc phosphated | none | 0.3 |
| 1 | untreated | dip for 5 minutes, rinse with deionized water, blow dry | 5 |
| 2 | untreated | same as 1, but sample baked for 5 minutes at 400° F. (204° C.) instead of blowing dry | 8 |
| 3 | untreated | same as 1, but sample drip dried at room temperature instead of blowing dry | 5 |
| 4 | untreated | same as 3, but sample baked for 5 minutes at 400° F. (204° C.) after dripping dry | 6 |
| 5 | untreated | dip for 5 minutes, blow dry, bake for 5 minutes at 400° F. (204° C.) | complete delamination |
| 6 | iron phosphated | dip for 6 seconds, rinse with deionized water, blow dry | 4.2 |
| 7 | iron phosphated | same as 6, but panel baked for 5 minutes at 300° F. (149° C.) after blowing dry | 4.8 |
| 8 | iron phosphated | same as 6, but sample baked for 5 minutes at 400° F. (204° C.) after blowing dry | 4.8 |
| 9 | iron phosphated | dip for 6 seconds, rinse with deionized | 2.5 |

Table I-continued

| Example No. | Previous Steel Panel Treatment | Ascorbic Acid Pretreatment Conditions | Scribe Creepage in millimeters (mm) |
|---|---|---|---|
| | | water, drip dry at room temperature | |
| 10 | iron phosphated | same as 9, but panel baked for 5 minutes at 300° F. (149° C.) after drip drying | 2.3 |
| 11 | iron phosphated | same as 9, but panel baked for 5 minutes at 400° F. (204° C.) after dripping dry | 4.8 |
| 12 | iron phosphated | dip for 6 seconds, blow dry, bake for 5 minutes at 400° F. (204° C.) | complete delamination |
| 13 | iron phosphated | dip for 6 seconds, drip dry at room temperature, bake for 5 minutes at 400° F. (204° C.) | complete delamination |

The data in Table I above shows the importance of rinsing the panel after the dipping operation. Blowing and dripping dry appear to be equivalent. No apparent advantage is gained by baking at elevated temperature.

EXAMPLES 14–23

A series of untreated and previously treated iron phosphated steel panels were dipped in a pretreatment bath containing 10 percent by weight ascorbic acid and 1 percent by weight of molybdenum metal powder.

Pretreatment conditions, topcoating and salt spray exposure were as generally described in Examples 1 through 13. The results are reported in Table II below. Control examples are shown at the beginning of the table.

Table II

| Example No. | Previous Steel Panel Treatment | Ascorbic Acid, Elemental Molybdenum Pretreatment Conditions | Scribe Creepage in mm |
|---|---|---|---|
| Control | untreated | none | complete delamination |
| Control | iron phosphated | none | 2.5 |
| 14 | untreated | dip for 5 minutes, rinse with deionized water, blow dry | 4 |
| 15 | untreated | same as 14, but panel baked for 5 minutes at 400° F. (204° C.) after blowing dry | 5 |
| 16 | untreated | dip for 5 minutes, blow dry, bake for 5 minutes at 400° F. (204° C.) | 31 |
| 17 | iron phosphated | dip for 6 seconds, rinse with deionized water, blow dry | 5 |
| 18 | iron phosphated | same as 17, but panel baked for 5 minutes at 300° F. (149° C.) | 4 |
| 19 | iron phosphated | same as 17, but panel baked for 5 minutes at 400° F. (204° C.) | 7 |
| 20[a] | iron phosphated | same as 17, but panel drip dried at room temperature rather than blowing dry | 1.2 |
| 21 | iron phosphated | same as 20, but panel baked for 5 minutes at 300° F. (149° C.) after dripping dry | 1.2 |
| 22 | iron phosphated | same as 20, but panel baked for 5 minutes at 400° F. (204° C.) after dripping dry | 2.8 |
| 23 | iron phosphated | dip for 6 seconds, blow dry, bake for 5 minutes at 400° F. (204° C.) | complete delamination |

[a]Preferred embodiment of the invention.

The results in Table II indicate that rinsing the pretreated panels is necessary to obtain good results. Also, baking the pretreated panels can be detrimental. Further, it was noted that without a rinse, the molybdenum powder mixed with the DURACRON coating during draw down to give a smeary gray-white surface topcoat. It should be noted at this point that the control examples for each series of experiments may vary somewhat. This is believed to be due to batch variations in the ferrous metal substrates and to variations in the salt spray chamber. However, in each particular series of examples, metal substrates from the same batch were selected and exposure was done in the same salt spray chamber.

EXAMPLE 24–37

A series of untreated and iron phosphated steel panels were dipped in pretreatment dispersions of 1 percent by weight molybdenum powder at 40° C.

Pretreatment, topcoating and salt spray exposure were as generally conducted in Examples 1 through 13. The results are reported in Table III below. Control examples are shown at the beginning of the table.

Table III

| Example No. | Previous Steel Panel Treatment | Molybdenum Pretreatment Conditions | Scribe Creepage in mm |
|---|---|---|---|
| Control | untreated | none | 11 |
| Control | iron phosphated | none | 2.7 |
| 24 | untreated | dip for 5 minutes, rinse with deionized water, blow dry | 10 |
| 25 | untreated | same as 24, but panel baked for 5 minutes at 300° F. (149° C.) after blowing dry | 8 |
| 26 | untreated | same as 24, but panel baked for 5 minutes at 400° F. (204° C.) after | 11 |

Table III-continued

| Example No. | Previous Steel Panel Treatment | Molybdenum Pretreatment Conditions | Scribe Creepage in mm |
|---|---|---|---|
| | | blowing dry | |
| 27 | untreated | dip for 5 minutes, rinse with deionized water, drip dry, bake 5 minutes at 300° F. (149° C.) | 4.2 |
| 28 | untreated | dip for 5 minutes, blow dry, bake 5 minutes at 400° F. (204° C.) | 9 |
| 29 | untreated | dip for 5 minutes, rinse with deionized water, drip dry, bake 5 minutes at 300° F. (149° C.) | 4.2 |
| 30 | iron phosphated | dip 6 seconds, rinse with deionized water and blow dry | 2.8 |
| 31 | iron phosphated | dip 6 seconds, rinse with deionized water, blow dry, bake 5 minutes at 300° F. (149° C.) | 4.8 |
| 32 | iron phosphated | same as 31, but sample blown dry at 400° F. (204° C.) | 6.8 |
| 33 | iron phosphated | dip for 6 seconds, rinse with deionized water, drip dry | 1.8 |
| 34 | iron phosphated | same as 33, but sample baked for 5 minutes at 300° F. (149° C.) after dripping dry | 3.1 |
| 35 | iron phosphated | same as 34, but panel baked for 5 minutes at 400° F. (204° C.) | 3.8 |
| 36 | iron phosphated | dip for 6 seconds, blow dry, bake 5 minutes at 400° F. (204° C.) | 6.0 |
| 37 | iron phosphated | dip for 6 seconds, drip dry at room temperature, bake 5 minutes at 400° F. (204° C.) | 5.0 |

EXAMPLES 38–52

In the following examples, the compositions used in the passivating pretreatment method of the invention were compared with ascorbic acid-diketone compositions disclosed in U.S. Pat. No. 3,349,043 to Manning et al. Representing the compositions of the present invention were 10 percent by weight ascorbic acid solutions in deionized water (Composition A) and mixtures of 10 percent by weight ascorbic acid and one percent by weight molybdenum powder in deionized water (Composition B). These compositions were compared with aqueous mixtures described in column 3, lines 60–67, of U.S. Pat. No. 3,349,043, that is, 2 ounces of ascorbic acid and 16 ounces of 2,4-pentanedione in 1 gallon of water (Composition C). The three compositions were then used in a passivating pretreatment in a manner generally described above in connection with Examples 1–13 for both untreated and previously treated (iron phosphated) steel panels.

Control examples are reported in the beginning of the table.

Table IV

| Example No. | Previous Steel Panel Treatment | Pretreatment Composition | Pretreatment Conditions | Scribe Creepage in mm |
|---|---|---|---|---|
| Control | Untreated | | none | 9.6 |
| Control | iron phosphated | | none | 5.0 |
| Control | iron phosphated with chromic acid rinse | | none | 0.2 |
| Control | zinc phosphated | | none | 0.1 |
| 38 | untreated | A | dip for 5 minutes, blow dry | complete delamination |
| 39 | untreated | A | dip for 5 minutes, rinse with deionized water, blow dry | 3.8 |
| 40 | untreated | A | dip for 5 minutes, rinse with deionized water, blow dry | 3.0 |
| 41 | untreated | B | same as 38 | complete delamination |
| 42 | untreated | B | same as 39 | 3.5 |
| 43 | untreated | B | same as 40 | 3.0 |
| 44 | untreated | C | same as 38 | 12.2 |
| 45 | untreated | C | same as 40 | 3.6 |
| 46 | untreated | C | same as 40 but bath temperature 25° C. | 5.2 |
| 47 | iron phosphated | A | dip 6 seconds, blow dry | 95% delamination |
| 48 | iron phosphated | A | dip for 6 seconds, rinse with deionized water and drip dry | 1.1 |
| 49 | iron phosphated | B | same as 47 | 70% delamination |
| 50 | iron phosphated | B | same as 48 | 0.9 |
| 51 | iron phosphated | C | same as 48 | 95% delamination |
| 52 | iron phosphated | C | same as 48 | 1.5 |

Examples 40, 43, and particularly 48 and 50 show the improvement of the invention over the prior art. Untreated steel panels treated in accordance with the invention (Examples 40 and 43) are superior to the control panels and to the panels treated with the prior art composition (Example 46). Iron phosphated steel panels treated in accordance with the invention (Examples 48 and 50) are far superior to the control panel and to the panels treated with the prior art composition (Example 52).

I claim:

1. An ecological method of providing corrosion resistance to metal surfaces, comprising:

(A) contacting the metal surface with an ascorbic acid-containing composition free of beta-diketones, (B) rinsing the pretreated metal surface to remove excess treating composition, (C) directly coating the pretreated metal surface with a film-forming material.

2. The method of claim 1 in which the ascorbic acid-containing composition is in aqueous medium.

3. The method of claim 2 in which the ascorbic acid constitutes at least 5 percent by weight of the aqueous medium based on total weight of the ascorbic acid and aqueous medium.

4. The method of claim 1 in which the metal substrate is first immersed in an aqueous composition of the ascorbic acid, removed therefrom, rinsed with water and dried.

5. The method of claim 1 in which the film forming material is a layer of paint.

6. A method of providing improved corrosion resistance to a metal surface, comprising:

(A) contacting the metal surface with a composition obtained by mixing elemental molybdenum and ascorbic acid, (B) rinsing the metal surface to remove excess treating composition, (C) directly coating the pretreated metal surface with a film-forming material.

7. The method of claim 6 in which the weight ratio of ascorbic acid to molybdenum is at least 5 to 1.

8. The method of claim 6 in which the composition is in aqueous medium.

9. The method of claim 8 in which the treating composition contains:

(A) from about 0.05 to 5 percent by weight of molybdenum, (B) from about 5 to 24 percent by weight of ascorbic acid, and (C) from about 75 to 94 percent by weight of aqueous medium; the percentages by weight being based on total weight of (A), (B) and (C).

10. The method of claim 9 in which the metal substrate is first immersed in an aqueous composition of the molybdenum and ascorbic acid, removed therefrom, rinsed with water and dried.

11. The method of claim 6 in which the film forming material is a layer of paint.

* * * * *

UNITED STATES PATENT AND TRADEMARK OFFICE

CERTIFICATE OF CORRECTION

PATENT NO. : 4,120,996

DATED : October 17, 1978

INVENTOR(S) : Nicholas T. Castellucci

It is certified that error appears in the above-identified patent and that said Letters Patent are hereby corrected as shown below:

Column 2, line 4, "pesence" should be --presence--; line 17, "Ovoshchesuch." should be --Ovoshchesush.--; line 30, "deum" should be --denum--; and line 33, "of" should be --to--.

Column 3, line 8, "higher" should be --Higher--.

Column 4, line 36, "marking" should be --masking--.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*